United States Patent [19]

Becka

[11] 4,150,454

[45] Apr. 24, 1979

[54] UPPER MOLDING AND FLANGING MACHINE

[75] Inventor: Michael M. Becka, Nashau, N.H.

[73] Assignee: International Shoe Machine Corporation, Nashua, N.H.

[21] Appl. No.: 890,747

[22] Filed: Mar. 27, 1978

[51] Int. Cl.[2] ..... A43D 11/00; A43D 21/00

[52] U.S. Cl. ..... 12/53.5; 12/12.5

[58] Field of Search ..... 12/53.5, 12.4, 12.5, 12/8.2, 54.3, 54.4, 54.6, 146 R, 146 D

[56] References Cited

U.S. PATENT DOCUMENTS

| | | | |
|---|---|---|---|
| 2,915,765 | 12/1959 | Lauretti | 12/53.5 |
| 3,007,182 | 11/1961 | Lauretti | 12/53.5 |
| 3,316,572 | 5/1967 | Forma et al. | 12/12.5 |
| 3,705,434 | 12/1972 | Knight et al. | 12/53.5 |

*Primary Examiner*—Patrick D. Lawson

*Attorney, Agent, or Firm*—Albert Gordon

[57] ABSTRACT

A machine that molds an upper to the shape of a male mold by a female mold that presses the upper against the male mold and that flanges the margin of the upper by wipers that are mounted to the female mold for inward movement with respect to the female mold.

5 Claims, 7 Drawing Figures

UPPER MOLDING AND FLANGING MACHINE

BACKGROUND OF THE INVENTION

U.S. Pat. Nos. 2,915,765, 3,007,182 and 3,705,434 are typical of molding machines, common to the prior art, that mold an upper to the shape of a male mold by pressing the upper against the male mold by a female mold having a back part and side parts mounted for inward-outward movement with respect to the back part. In U.S. Pat. Nos. 2,915,765 and 3,007,182, wipers that are mounted and actuated separately from the female mold form a flange on the molded upper. In U.S. Pat. No. 3,705,434, wipers mounted on and immovable with respect to the back and side parts of the female mold act to form a flange on the molded upper.

SUMMARY OF THE INVENTION

The principle object of this invention is to provide a molding and flanging machine that has the same general objective as the machines of U.S. Pat. Nos. 2,915,765, 3,007,182 and 3,705,434 but which provides a more effective flanging mechanism which, nevertheless, is relatively simple in construction. Unlike the wipers of U.S. Pat. Nos. 2,915,765 and 3,007,182, the flanging wipers of this invention are mounted directly to the female mold so as to alleviate the need for a separate driving mechanism for the flanging wipers. Unlike the wipers of U.S. Pat. No. 3,705,434, the flanging wipers of this invention are movable inwardly with respect to the female mold to enable them to perform an effective flanging operation on the upper margin and to enable them to be out of interfering relationship with the upper that has been placed on the male mold and to still enable the wipers to be placed inwardly of the female mold when the female mold is pressing the upper against the male mold a sufficient distance to form the desired flange on the upper. In accordance with this invention, the wipers are so mounted to the female mold as to cause the wipers to move inwardly with respect to the female mold side parts pursuant to the inward movement of the side parts.

DESCRIPTION OF THE PREFERRED EMBODIMENT

Figure 1:
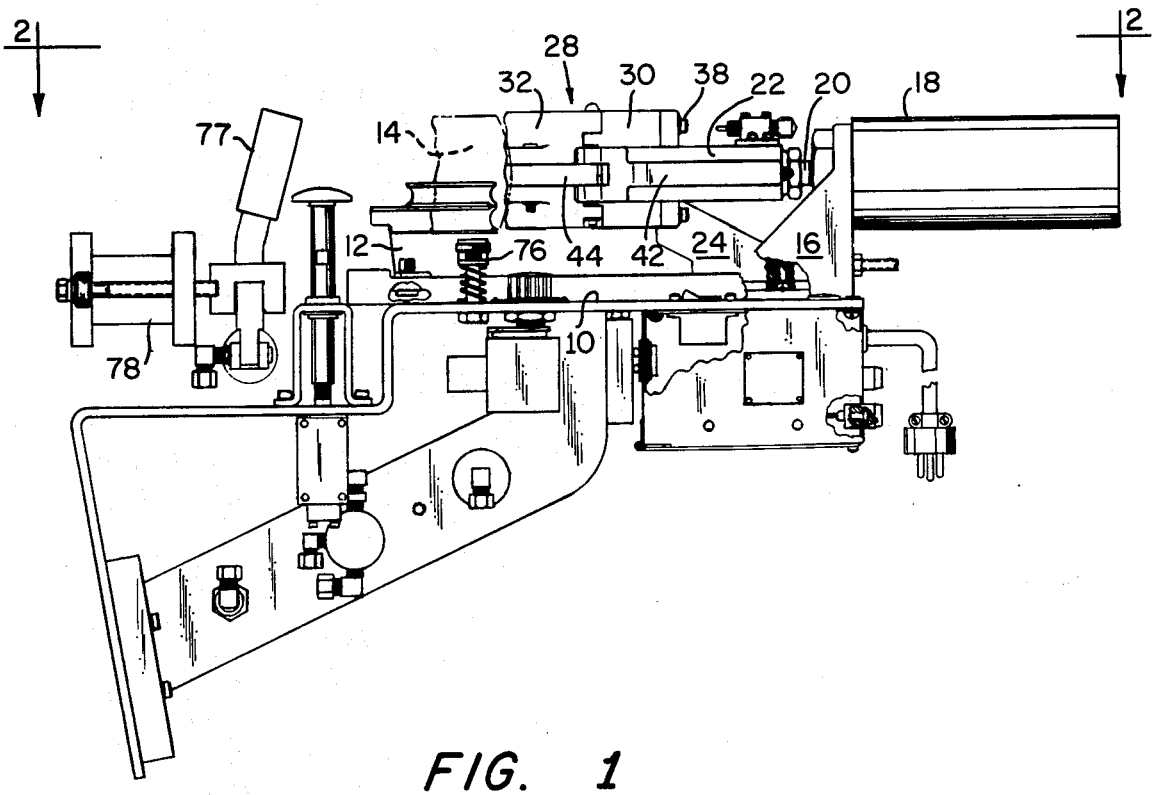
FIG. 1 is a side elevation of the machine.

Although, in actuatality, the machine as depicted in FIG. 1 is mounted close to the vertical with the parts at the right end of FIG. 1 being the uppermost parts of the machine and the parts at the left end of FIG. 1 being the lowermost parts of the machine, for convenience of description the machine will be considered to be mounted horizontally as shown in FIG. 1. As seen in FIG. 1 the left ends of machine parts will be considered to be their fronts and the right ends of machine parts will be considered to be their backs. Also as seen in FIG. 1, right to left movements and directions will be considered to be "forward" and left to right movements and directions will be considered to be "rearward".

Figure 2:
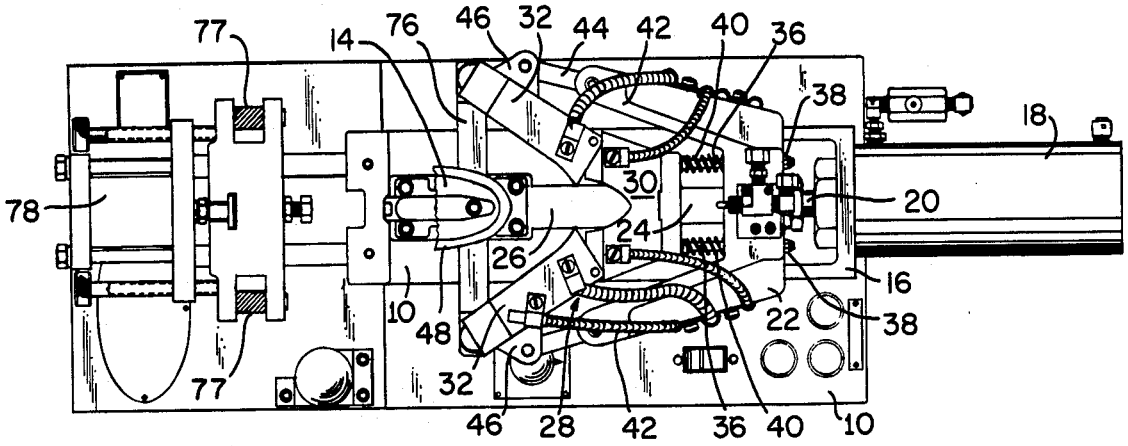
FIG. 2 is a plan view of the machine taken on the line 2—2 of FIG. 1.

Referring to FIGS. 1 and 2, the machine includes a base 10 having a column 12 upstanding therefrom. A male mold 14 is secured to the column 12.

A bracket 16, mounted to the base 10, has a pneumatic motor 18 secured thereto. The piston rod 20 of the motor 18 is secured to a yoke 22. A female mold 28 is mounted to and extends forwardly of the yoke 22. The mold 28 comprises a back part 30 and a pair of side parts 32. The side parts 32 are pivoted to opposite sides of the front of the back part 30 by pivot pins 34 (see FIGS. 3 and 4) and extend forwardly and divergently from the back part 30. A plurality of bolts 36 are mounted to the back part 30 and extend rearwardly thereof through holes in the yoke 22. A nut 38 is threaded onto each bolt 36, each nut 38 being located rearwardly of the yoke 22. A compression spring 40 is entwined about each bolt 36 between the back part 30 and the yoke 22 to thereby yieldably urge the back part 30 forwardly of the yoke 22 to an extent determined by the engagement of the nuts 38 with the back of the yoke 22. The back part 30 is slidably mounted to the base 10 for forward-rearward movement by being secured to a slide 24 that is slidably mounted in a forwardly-rearwardly extending slot 26 in the base 10.

The yoke 22 has forwardly and divergently extending arms 42. A link 44 is pivoted to and extends forwardly of the front of each arm 42 and the front of each link 44 is pivoted to a pair of lugs 46 that are secured to a side part 32.

Figure 4:
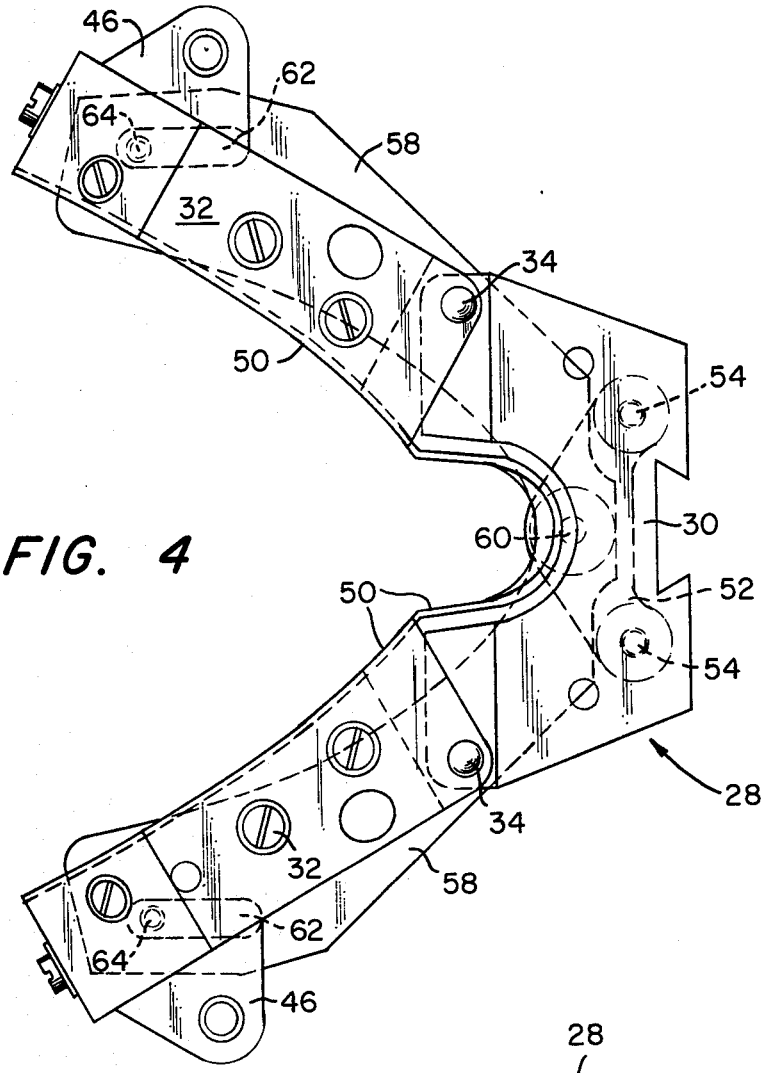
FIG. 4 is a plan view taken on the line 4—4 of FIG. 3.
Figure 3:
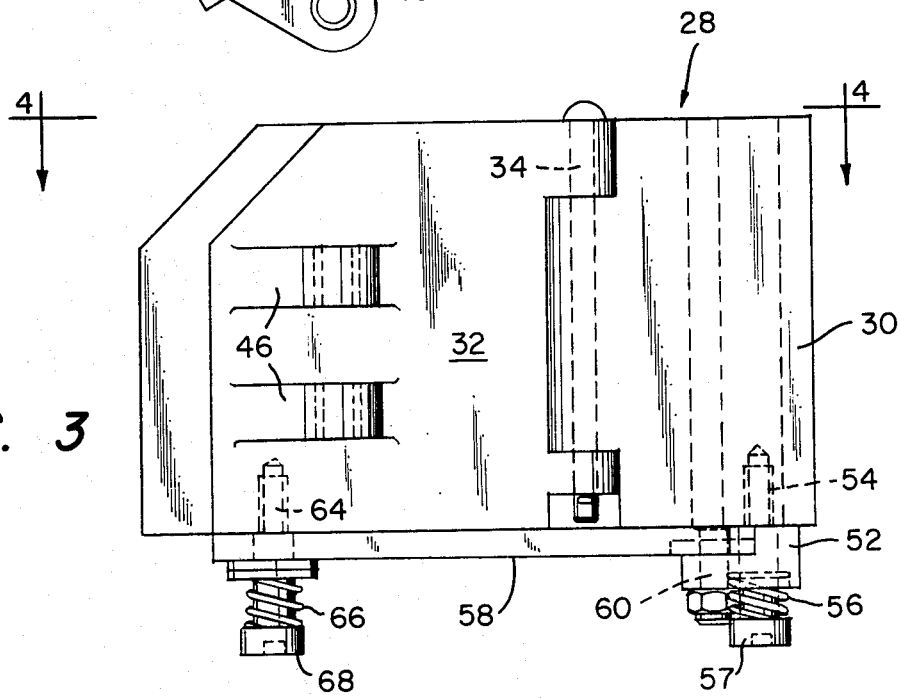
FIG. 3 is a side elevation of the female mold having the wipers mounted thereto.

A liner 48 of a flexible material such as Teflon may be secured to the periphery of the male mold 14 (see FIG. 2) and a similar liner 50 (see FIG. 4) may extend along the inner peripheries of the back part 30 and the side parts 32 of the female mold 28. Referring to FIGS. 3 and 4, a bracket 52 is mounted to the bottom of the female mold back part 30 by a pair of bolts 54 that are threaded into the back part 30 and extend downwardly thereof through holes in the bracket 52. Compression springs 56, entwined about the bolts 54 and interposed between the bracket 52 and the bolt heads 57, serve to yieldably urge the bracket 54 against the back part 30. A pair of wipers 58 are pivoted at their backs to a pin 60 on the bracket 52 and extend forwardly and divergently of the pin 60 below the female mold side parts 32. A forwardly-rearwardly extending slot 62 extends through the front end of each wiper 58. A bolt 64 is threaded into each side part 32 and extends downward thereof through its associated slot 62. A compression spring 66, entwined about each bolt 64 and extending between its associated wiper 58 and the head 68 of its associated bolt 64, acts to yieldably urge the front of its associated wiper 58 against its associated side part 32.

In the idle condition of the machine the piston rod 20 is retracted into the motor 18 to thereby retain the yoke 22 in a rearward position with the springs 40 pushing the female mold back part 30 forwardly of the yoke 22 to a position wherein the nuts 38 engage the back of the yoke 22. In this position, the links 44 maintain the female mold side parts 32 relatively far from each other and from the sides of the male mold 14 and the connection formed by the slots 62 and the bolts 64 maintains the wipers swung about the pin 60 relatively far from each other.

Figure 5:
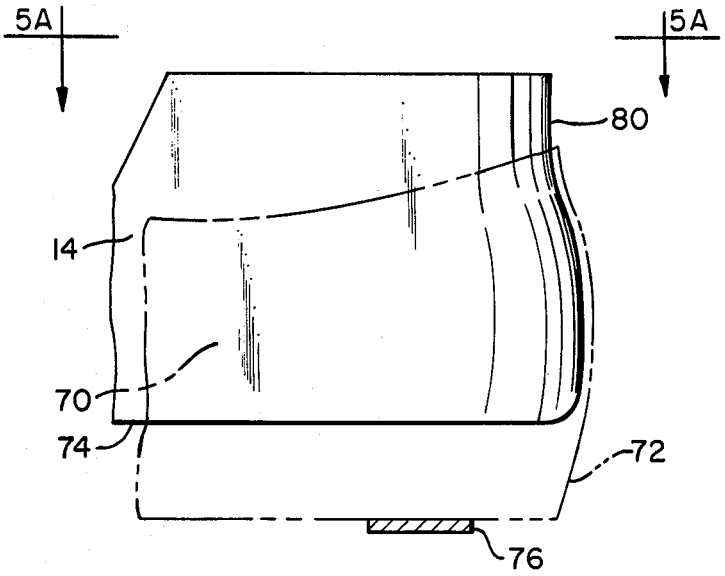
FIG. 5 is a schematic representation of the male mold having the upper draped thereon.
Figure 5A:
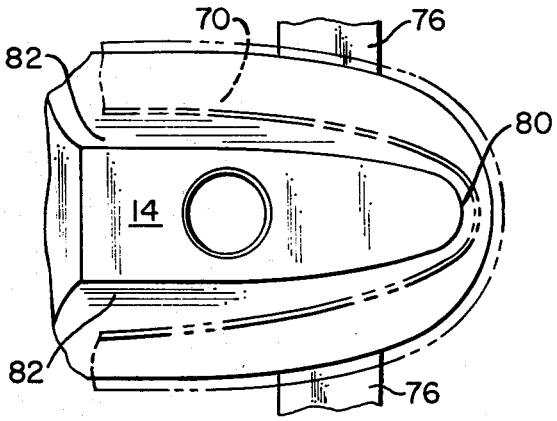
FIG. 5A is a view taken along the line 5A—5A of FIG. 5.

Referring to FIGS. 5 and 5A, the quarter of the upper 70 is draped about the male mold 14 with the margin 72 of the upper extending downwardly of the bottom 74 of the male mold 14 and resting on a gauge plate 76. The gauge plate 76, as shown in FIGS. 1 and 2, is mounted to the base 10. The forepart portions of the upper are gripped by pincers 77 and the pincers 77 are yieldably moved forwardly by a pneumatic motor 78 (see FIGS. 1 and 2) to force the heel end extremity of the upper against the back end 80 of the male mold 14.

Now the motor 18 is actuated to project its piston rod yieldably forwardly under the force of pressurized air to thereby move the yoke 22 and the female mold 28 forwardly. This forward movement of the female mold continues until the forward movement of the back part 30 is arrested by the heel end 80 of the mold 14 with the heel end of the upper 70 interposed between the male mold 14 and the female mold back part 30. Continued forward movement of the yoke 22 causes the yoke 22 to move forwardly of the now stationary bolts 36, causes the springs 40 to be compressed and causes the links 44 to swing the female mold side parts 32 inwardly about the axes of the pins 34 until the side parts 32 press the side portion of the upper against the sides 82 of the male mold 14.

Pursuant to the inward movement of the side parts 32, due to the connection formed by the slots 62 and the bolts 64 between the side parts 32 and the wipers 58, the wipers 58 are caused to move inwardly of the side parts 32 to engage the upper margin 72 and wipe or fold the upper margin against the bottom 74 of the male mold 14. During the inwiping movement of the wipers 58, the springs 56,66 enable the wipers to yieldably move downwardly of the male mold 14, should this downward movement be necessary, in order for the wipers 58 to be able to move beneath the male mold bottom 74 during their wiping movements.

Figure 6:
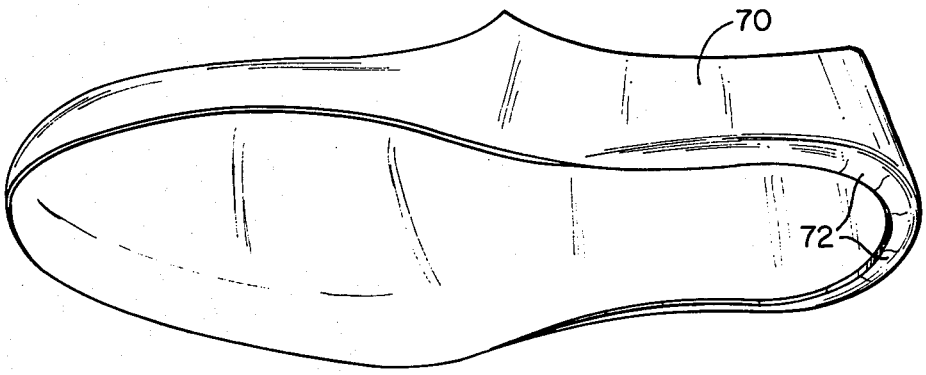
FIG. 6 is an isometric view of the upper with the flange thereon as it appears after it has been operated by the machine of this invention.

As is conventional, the upper quarter has a thermoplastic counter that is rigid at ambient temperatures incorporated therein, and the male mold 14 and/or the female mold 28 have electric cartridge heaters incorporated therein. The heat from the electric cartridge heaters softens the upper and the counter to the shape of the male mold 14 during the molding operation that takes place during the pressing of the upper quarter by the female mold 28 against the male mold 14. When the upper is removed from the machine pursuant to the return of the machine parts to their idle conditions, the counter reverts to its rigid condition and the upper quarter retains the shape imparted to it during the molding operation with the quarter of the upper margin 72 being formed into an inwardly directed flange by the flanging operation that takes place during the aforementioned inwiping movement of the wipers 58. FIG. 6 illustrates the upper 70 having the flanged margin 72 at its quarter after the upper has been removed from the machine.

After removal from the machine of this invention, the upper 70 is mounted on a last having an insole secured to its bottom. The shoe assembly, formed of the last, the upper, and the insole, is then presented to a toe pulling over and lasting machine of the type shown in U.S. Pat. No. Re.29,069 for a pulling over and toe lasting operation. The flanged upper margin 72 at the quarter of the upper facilitates the proper placement of the upper on the last and minimizes the manual manipulation of the upper on the last by the operator during the operation of the pulling over and toe lasting machine.

There follows a recapitulation of the machine and its mode of operation as they pertain to this invention.

The machine comprises the male mold 14 and the female mold 28. The female mold 28 has the back part 30 and the side parts 32 with the side parts being mounted for inward-outward movement with respect to the back part. The motor 18 forms means for imparting such relative forward movement of the female mold 28 with respect to the male mold 14 as to cause the back part 30 to press an end of the upper 70 mounted on the male mold 14 against the corresponding end 80 the male mold end and to cause the side parts 32 to move inwardly and press side portions of the upper against the sides 82 of the male mold 14. A wiper 58 is associated with each side part 32 and the machine includes wiper operating means effective to impart inward movement of the wipers 58 with respect to their associated side parts to thereby enable the wipers 58 to form a flange on the margin 72 of the upper 70. The wiper operating means are comprised of mounting means formed by the members 52, 54, 56, 62, 64, and 66, this mounting means so mounting the wipers 58 to their associated side parts 32 as to impart inward movement of the wipers with respect to their associated side parts pursuant to said inward movement of the side parts.

The mounting means comprises: a back pivotal connection, formed by the pin 60, so pivotally mounting the backs of the wipers 58 to the back part 30 that the wipers 58 extend forwardly and divergently of the back pivotal connection 60; and a front connection, formed by the members 62 and 64, between the fronts of the wipers 58 and their associated side parts 32 so constructed as to enable the wipers 58 to move inwardly of their associated side parts 32 about the back pivotal connection 60 pursuant to said inward movement of the side parts 32.

The back pivotal connection is formed by the pin 60 on the bracket 52. The members 54, 56 form bracket mounting means that mount the bracket 52 to the back part 30. The front connections comprise the slots 62 extending through the fronts of the wipers 58 and the bolts 64 which form front studs that are mounted to each side part 32 and extend through the slot 62 of its associated wiper 58.

The springs 56 act as back spring means yieldably urging the bracket 52 against the back part 30 and the springs 66 act as front spring means yieldably urging the fronts of the wipers 58 against their associated side parts 32.

The bolts 54 form back studs extending from the back part 30 on which the bracket 52 is movably mounted. The springs 56 are so mounted to the back studs 56 as to yieldably urge the bracket 52 against the back part 30. The springs 66 are so mounted to each front stud 64 as to yieldably urge the front of each wiper 58 against its associated side part 32.

I claim:

1. An upper molding and flanging machine comprising: a male mold; a female mold having a back part and side parts, said side parts being mounted for inward-outward movement with respect to the back part; means for imparting such relative forward movement of the female mold with respect to the male mold as to cause the back part to press an end of an upper mounted on the male mold against the corresponding end of the male mold and to cause the side parts to move inwardly and press side portions of the upper against the sides of the male mold; a wiper associated with each side part; and wiper operating means effective to impart inward movement of the wipers with respect to their associated side parts to thereby enable the wipers to form a flange on the margin of the upper; characterized in that the wiper operating means comprises: mounting means so mounting the wipers to the female mold as to impart inward movement of the wipers with respect to their associated side parts pursuant to said inward movement of the side parts.

2. The machine of claim 1 characterized in that said mounting means comprises: a back pivotal connection so pivotally mounting the backs of the wipers to the back part that the wipers extend forwardly and divergently of the back pivotal connection; and a front connection between the fronts of the wipers and their associated side parts so constructed as to enable the wipers to move inwardly of their associated side parts about the back pivotal connection pursuant to said inward movement of the side parts.

3. The machine of claim 2 characterized in further comprising: a bracket; and a pin on the bracket to which the back of the wipers are pivoted to thereby form said back pivotal connection; and bracket mounting means mounting the bracket to said back part; and characterized in that said front connections comprise: a slot extending through the front of each wiper; and a front stud mounted to each side part and extending through the slot of its associated wiper.

4. The machine of claim 3 characterized in comprising: back spring means yieldably urging the bracket against the back part; and front spring means yieldably urging the fronts of the wipers against their associated side parts.

5. The machine of claim 4 characterized in that said bracket mounting means comprises: at least one back stud extending from the back part on which the bracket is movably mounted; characterized in that said back spring means comprises a back spring so mounted to the back stud as to yieldably urge the bracket against the back part; and characterized in that said front spring means comprises a front spring so mounted to each front stud as to yieldably urge the front of each wiper against its associated side part.

* * * * *